US005570881A

United States Patent [19]

Lau

[11] Patent Number: 5,570,881

[45] Date of Patent: Nov. 5, 1996

[54] SCORING EQUIPMENT FOR A SWORD CONTEST SPORT

[76] Inventor: Anthony Lau, 58-17 College Pt. Blvd., Flushing, N.Y. 11355

[21] Appl. No.: 327,914

[22] Filed: Oct. 24, 1994

[51] Int. Cl.[6] ..... A63B 69/02

[52] U.S. Cl. ..... 273/57.3; 2/10; 2/425; 2/424; 602/16

[58] Field of Search ..... 273/440, 57.3; 2/15, 10, 424, 425; 602/16

[56] References Cited

U.S. PATENT DOCUMENTS

| | | |
|---|---|---|
| D. 257,635 | 12/1980 | Carreiro . |
| D. 329,510 | 9/1992 | Lin . |
| 1,170,462 | 2/1916 | Schroeder . |
| 1,956,201 | 4/1934 | Roberts . |
| 2,813,271 | 11/1957 | Finken . |
| 2,998,974 | 9/1961 | Stafford . |
| 3,324,851 | 6/1967 | Posner . |
| 3,456,947 | 7/1969 | Borgford . |
| 3,514,784 | 6/1970 | McDavid . |
| 3,516,662 | 6/1970 | Kuenstler, Jr. . |
| 4,569,666 | 2/1986 | Wolf . |
| 4,892,303 | 1/1990 | Lohre . |

*Primary Examiner*—Paul E. Shapiro

*Attorney, Agent, or Firm*—Price, Heneveld, Cooper, DeWitt & Litton

[57] ABSTRACT

Scoring equipment particularly adaptable to a sword combat sport, includes a limb target and a helmet. The limb target has a base configured to be worn by a user at a location near a joint of the user's limb. A lever is pivotally mounted on the base and extends to a lever terminal end. The lever terminal end is fastened to the user on a side of the user's joint opposite the base. A locking mechanism is connected between the base and the lever. The locking mechanism has a set condition in which articulation of the user's joint is unencumbered by the scoring equipment. The locking mechanism also has a tripped condition in which the locking mechanism restricts the rotation of the lever relative to the base and thereby restricts the articulation of the user's joint. The locking mechanism is responsive to a force applied to the locking mechanism to place the locking mechanism in the tripped condition from the set condition. The helmet has a visor pivotally attached to the helmet and movable between a first position in which a user's vision is unobstructed by the visor and a second position in which the visor obstructs the user's vision. At least one additional target for holding the visor in the first or stored position and releasing the visor to the second or deployed position is connected with the visor and positioned either upon the helmet or separately from the helmet upon the user.

15 Claims, 5 Drawing Sheets

SCORING EQUIPMENT FOR A SWORD CONTEST SPORT

BACKGROUND OF THE INVENTION

The invention relates to sports equipment and more particularly to scoring equipment which is adapted to sports in which two individual contestants face and compete with each other in a fighting contest of skill, strength, and stamina. Such sporting contests most notably include fencing, boxing, and the various martial arts, for example.

The scoring of contests in these sports traditionally and commonly require close observance by a panel of judges. This method or procedure is inherently fraught with subjectiveness and the limitations of human perception. The present method of scoring in these individual participation and physical contact sports also predisposes the contestants to a high risk of personal injury.

One will, therefore, appreciate the long standing need for more uniform and objective scoring in these sporting contests. One will also appreciate the desirability of enhanced scoring to diminish the risk levels for personal injury in these sporting contests.

SUMMARY OF THE INVENTION

Accordingly, the invention presents scoring equipment which includes a first portion worn on a limb of a contestant, near a joint of that limb; a second portion worn by the contestant, near the joint, on a side of the joint opposite the first portion; and a locking mechanism interconnecting the first and second portions so the first and second portions are generally rotatably movable about a pivot axis. The locking mechanism has a set position in which the first and second portions are generally rotatably movable about the pivot axis, and has a tripped position in which the locking mechanism restricts the movement of the first and second portions. Thus, the scoring equipment simulates a disablement by restricting the contestant's movement when the locking mechanism is placed in the tripped position by an opponent in the sporting contest. The score is objectively determined and the participant is protected from actual injury while obtaining a realistic result.

In one aspect of the invention, the contestant's joint has an axis of rotation and the pivot axis of the scoring equipment is oriented generally parallel with the joint's axis of rotation. In another aspect of the invention, the locking mechanism includes a target which is responsive to a force applied to the target, such as a striking blow from an opponent, for example. In response to the force, the locking mechanism is placed in the tripped position.

In another aspect of the invention, the locking mechanism also includes a ratchet mechanism. When the locking mechanism is in the tripped position, the ratchet mechanism prohibits rotation of the first and second portions in a predetermined rotational direction about the pivot axis. In yet another aspect of the invention, the ratchet mechanism includes a cog and a cooperating pawl with the pawl being biased to engage the cog. In a further aspect of the invention, the locking mechanism includes a reset device connected with the pawl. The reset device is adapted to be manipulated by a user to draw the pawl away from the cog and place the locking mechanism in the set position.

These and other features, objects, and benefits of the invention will be recognized by those who practice the invention and by those skilled in the art, from the specification, the claims, and the drawing figures.

DESCRIPTION OF THE PREFERRED EMBODIMENTS

Figure 1:
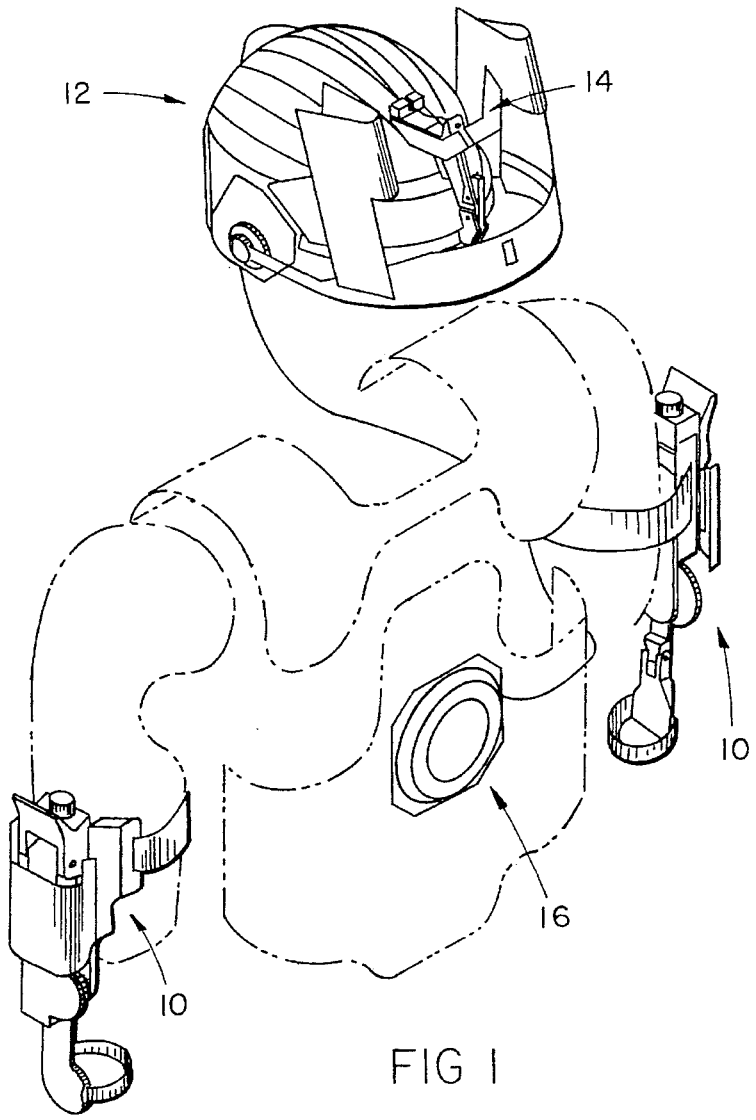
FIG. 1 is a schematic perspective view, partially in phantom, showing scoring equipment according to the invention as it would be worn by a user.

One embodiment of scoring equipment according to the present invention is generally shown in the drawing figures. As shown in FIG. 1, the equipment may include limb targets 10 and 10' and a helmet 12 with both a helmet target 14 and a chest target 16. As specifically shown in the drawing figures (1–8), limb targets 10 and 10' are configured for the elbows of a user's arms, but the limb targets may also be adapted to be worn elsewhere by a user, including at the shoulder, knee, or hip, for example. Further, a limb target 10 is specifically configured for use on a user's right arm, while limb target 10' is a mirror image duplicate, specifically configured for use on the left arm. Thus, only limb target 10 will be discussed in detail.

The limb target 10 includes three main portions, namely, a base 20, a lever 22, and a lock assembly or mechanism 24 (FIGS. 2–6). The lever 22 is interconnected with base 20 at a lock pivot 26 by lock assembly 24. The base 20 is most preferably provided with an arcuate bottom surface 30 for a snug fit upon a user. Base 20 may be fabricated of any suitable material and is preferably cast or molded of a durable lightweight material, which may include copolymer or ABS plastics or metal alloys, for example.

An attachment strap 32 is also provided to securely strap base 20 to the user. Attachment strap 32 may be any of various attachment straps which are commonly known for and used with sporting equipment, including, but not limited to, a solid strip of plastic or metal or a length of a woven fabric strapping or the like, with any of various available fasteners, including, hook and loop fabric fasteners, snap fasteners, or buckle fasteners, for example.

Figure 2:
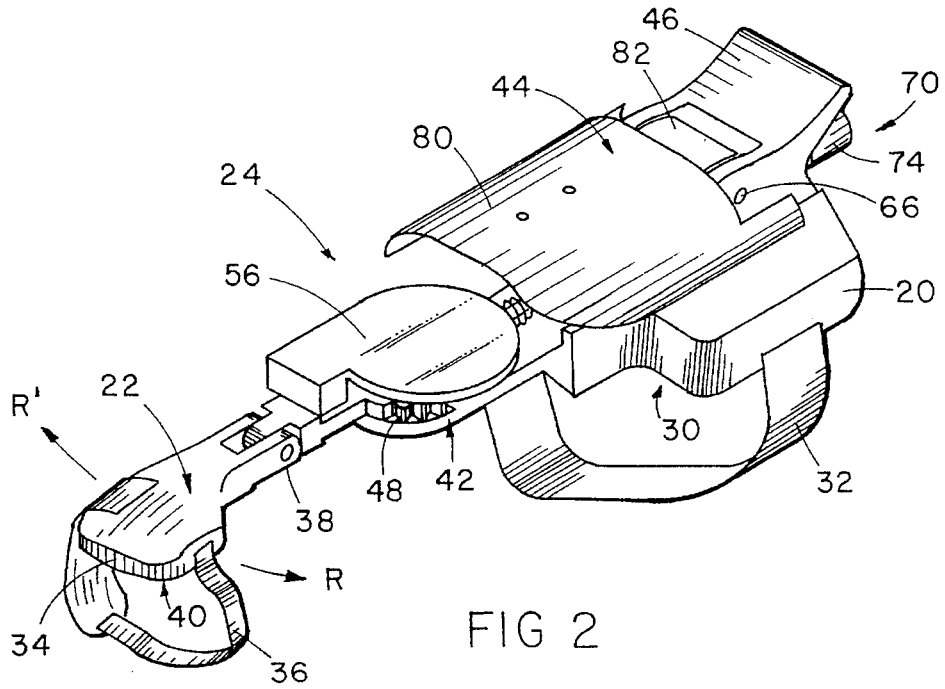
FIG. 2 is a perspective view of the limb target shown in FIG. 1.
Figure 3:
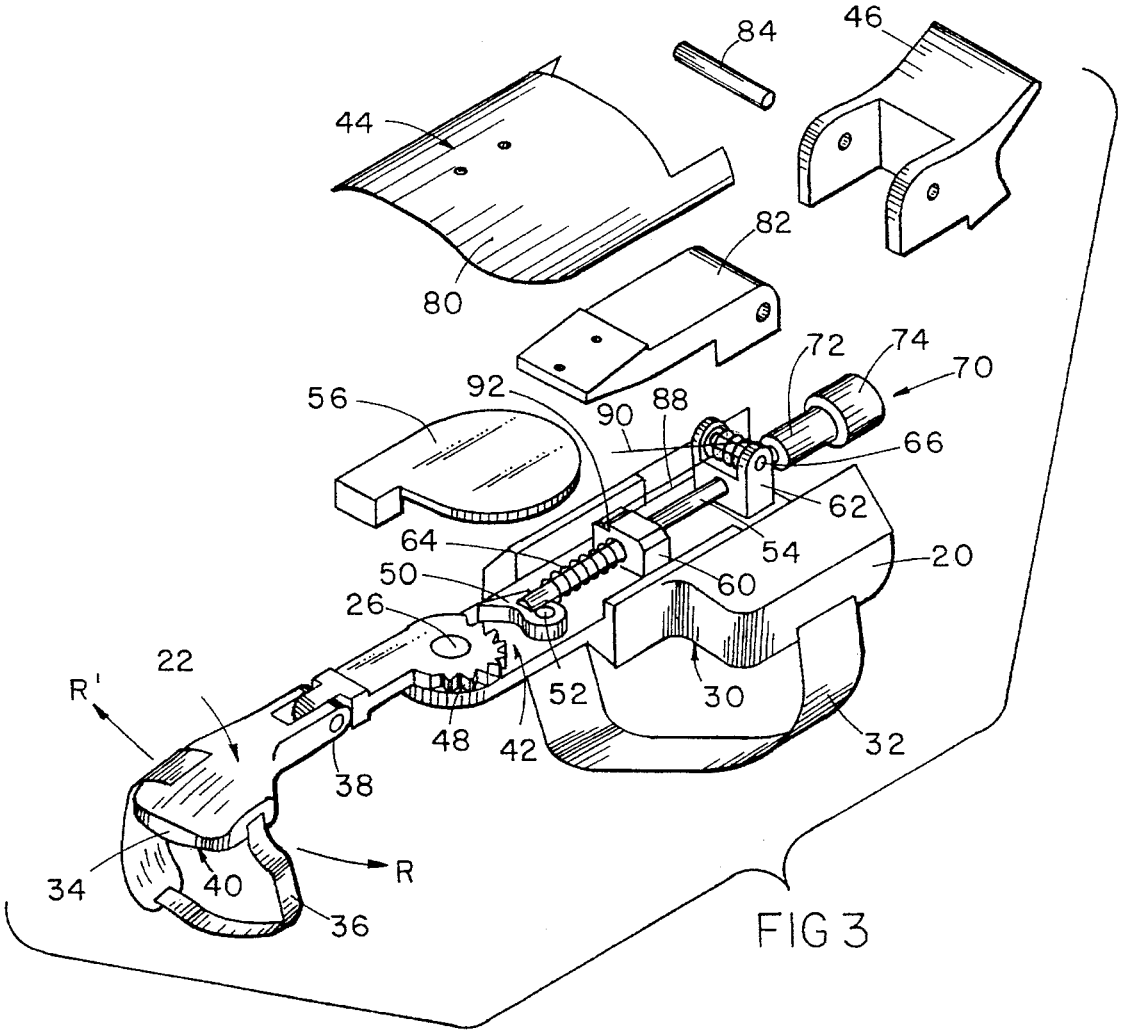
FIG. 3 is an exploded perspective view of the limb target of FIG. 2.

The lever 22 extends from base 20 to a lever terminal end 34 and includes an attachment member 36 to securely mount lever terminal end 34 upon a user (FIGS. 2 and 3). Attachment member 36 may be any of various suitable and commonly known materials and fastened by any of the various commonly known and suitable fasteners, all as discussed in greater detail regarding attachment strap 32, above. To enhance the ability of limb target 10 to conform to and better fit a user, lever 22 may be an articulated member having a lever pivot 38 located between lever terminal end 34 and lock pivot 24, at base 20. The lever terminal end 34 is also most preferably provided with an arcuate bottom surface 40 for a snug fit upon the user.

The lock assembly 26 generally includes a ratchet device 42, a target strike 44, and a reset 46. The ratchet device 42 includes a series of cogs 48 radially disposed about pivot 24 on an end of lever 22, opposite lever terminal end 34. A pawl 50 (FIG. 3) is pivotally mounted at a pawl pivot 52, on base 20, to rotate into and out of engagement with the cogs 48. An actuator rod 54 is pivotally connected with pawl 50 and extends from pawl 50 in a direction generally away from lever 22. A strike guard or housing plate 56 (FIGS. 2 and 3) may be provided to cover the ratchet device 42 and generally protect the lock assembly 26 from damage in use.

A pair of supports 60 and 62 extend from base 20 and are provided with aligned bores through the supports, to define guides for actuator rod 54. The support 62, located away from pawl 50, extends farther from base 20 than the other support 60, to a trigger pivot 66 (FIGS. 2–6) at which both target strike 44 and reset 46 are pivotally mounted to base 20.

Actuator rod 54 also extends through a helical pawl spring 64 that is positioned between pawl 50 and the support 60, located closer to pawl 50. The pawl spring 64 is sized for slip-fit engagement over actuator rod 54 and exerts a force against support 60 and pawl 50 to bias the pawl 50 toward and into engagement with cogs 48. Actuator rod 54 extends from pawl 50 to a terminal end 70 that is provided with a trigger catch 72 and a reset knob 74.

The target strike 44 is generally a lever member and may include a separate arcuate plate 80 (FIGS. 2 and 3) that is attached by any suitable method to a pivotable target lever 82 that extends from trigger pivot 66 at support 62, for example. Target strike 44, and more particularly target lever 82 is connected at support 62 by a trigger pivot pin 84. A trigger spring 86 is also mounted on trigger pivot pin 84. Trigger spring 86 is a helical coil spring with a pair of legs 88 and 90 extending from a body of the spring. One leg 88 of the trigger spring 86 engages a spring rest notch 92 defined in support 60. The other leg 90 of the trigger spring 86 bears against target strike 44 so trigger spring 86 will bias target strike 44 in a rotational direction about trigger pivot 66, away from ratchet 42, toward a set position. In the set position, target strike 44 is spaced away from ratchet 42, trigger catch 72 on actuator rod 54 abuts a trigger stop 94 (FIGS. 4–6) on target strike 44, and actuator rod 54 holds pawl 50 in disengagement from cogs 48, against the bias of pawl spring 64.

Release 46 is also pivotally connected with base 20 at trigger pivot 66. Release 46 is configured as a three-armed lever member. One arm 100 of release 46 engages trigger pivot 66, while a second arm 102 of release 46 extends generally away from target strike 44 and defines a finger grip 104. The third arm 106 of release 46 extends generally toward base 20 and away from each of the first 100 and second arms 102 of release 46, and is provided with a notch for straddling actuator rod 54 and selected engagement with reset knob 74.

Figure 4:
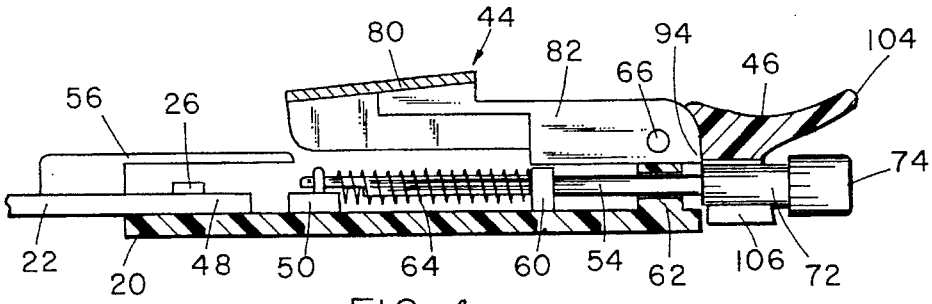
FIG. 4 is a fragmentary side elevational view of the limb target of FIG. 2, showing the target in a set condition.
Figure 6:
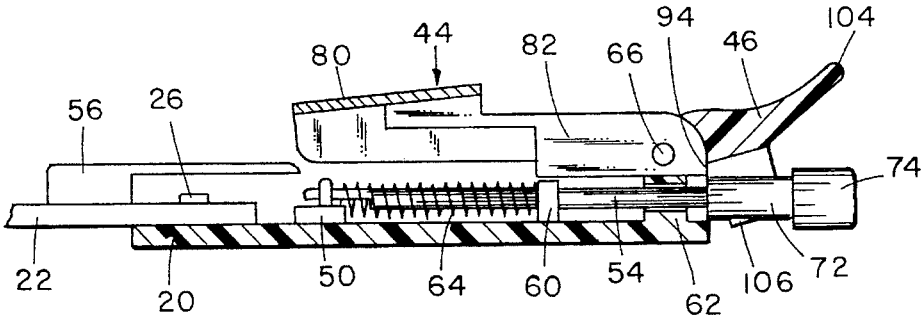
FIG. 6 is the view of FIG. 4 showing the target in a reset condition.
Figure 7:
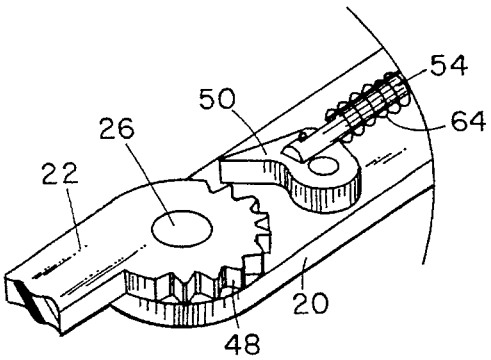
FIG. 7 is an enlarged detail from FIG. 3 showing the locking mechanism in a set condition.
Figure 8:
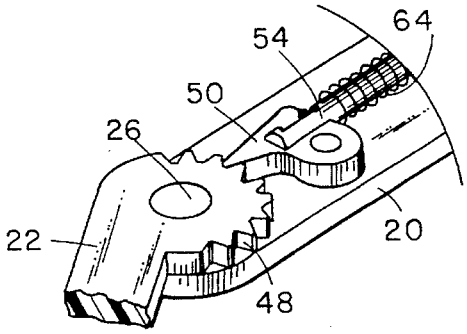
FIG. 8 is the view of FIG. 7 showing the locking mechanism in a tripped condition.

In use of limb target 10, and more particularly in use at a user's elbow, base 20 is positioned above the elbow on a side of the user's arm away from the user's torso, with an axis of lock pivot 26 oriented generally parallel to and most preferably located as close as possible to the rotational axis of the user's elbow. Base 20 is secured to the user's upper arm with attachment strap 32, and lever 22 is attached to the user's forearm with attachment member 36. If the limb target 10 is not already in the set position or condition, release 46 may be manipulated by grasping and pulling the finger grip 104 generally away from base 20. As shown in FIG. 6, the third leg 106 of release 46 will engage reset knob 74 of actuator rod 54 to draw the actuator rod 54 and pawl 50 away from cogs 48. Also, trigger catch 72 will move out from under target strike 44 and trigger spring 86 will rotate target strike 44 away from lever 22, to position trigger stop 94 for engagement with trigger catch 72. Upon release of reset 46, trigger catch 72 will abut trigger stop 94, holding actuator rod 54 and pawl 50 in the set position with pawl 50 disengaged from cogs 48 (FIG. 4). In the set position or condition, lever 22 rotates freely about lock pivot 26 as indicated by the arrows R and R' in FIGS. 2 and 3.

Figure 5:
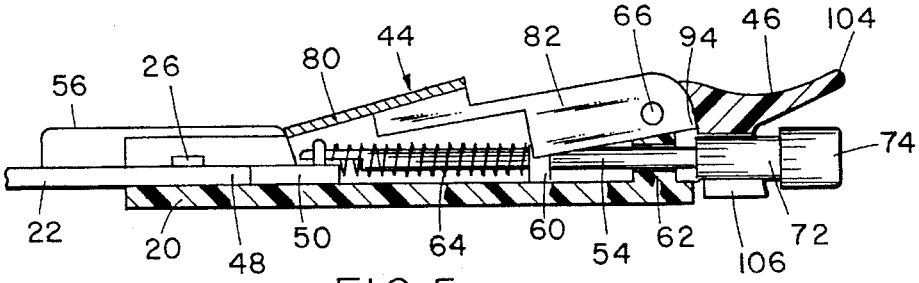
FIG. 5 is the view of FIG. 4 showing the target in a tripped condition.

Upon striking or otherwise depressing target strike 44 toward lever 22 and rotating target strike 44 about trigger pivot 66, trigger stop 94 rotates away from trigger catch 72 to release actuator rod 54 (FIGS. 2, 3, and 5). With actuator rod 54 released, pawl spring 64 moves pawl 50 into engagement with cogs 48 to activate the ratchet mechanism 42 of lock assembly 24. Thus, lock assembly 24 is placed in the tripped position or condition and pawl 50 limits the rotation of lever 22 to move only in a counter-clockwise direction as indicated by the arrows R in FIGS. 2 and 3. A scoring strike is thus affirmatively and objectively signalled and realistically simulated by disabling further use of the limb.

Figure 9:
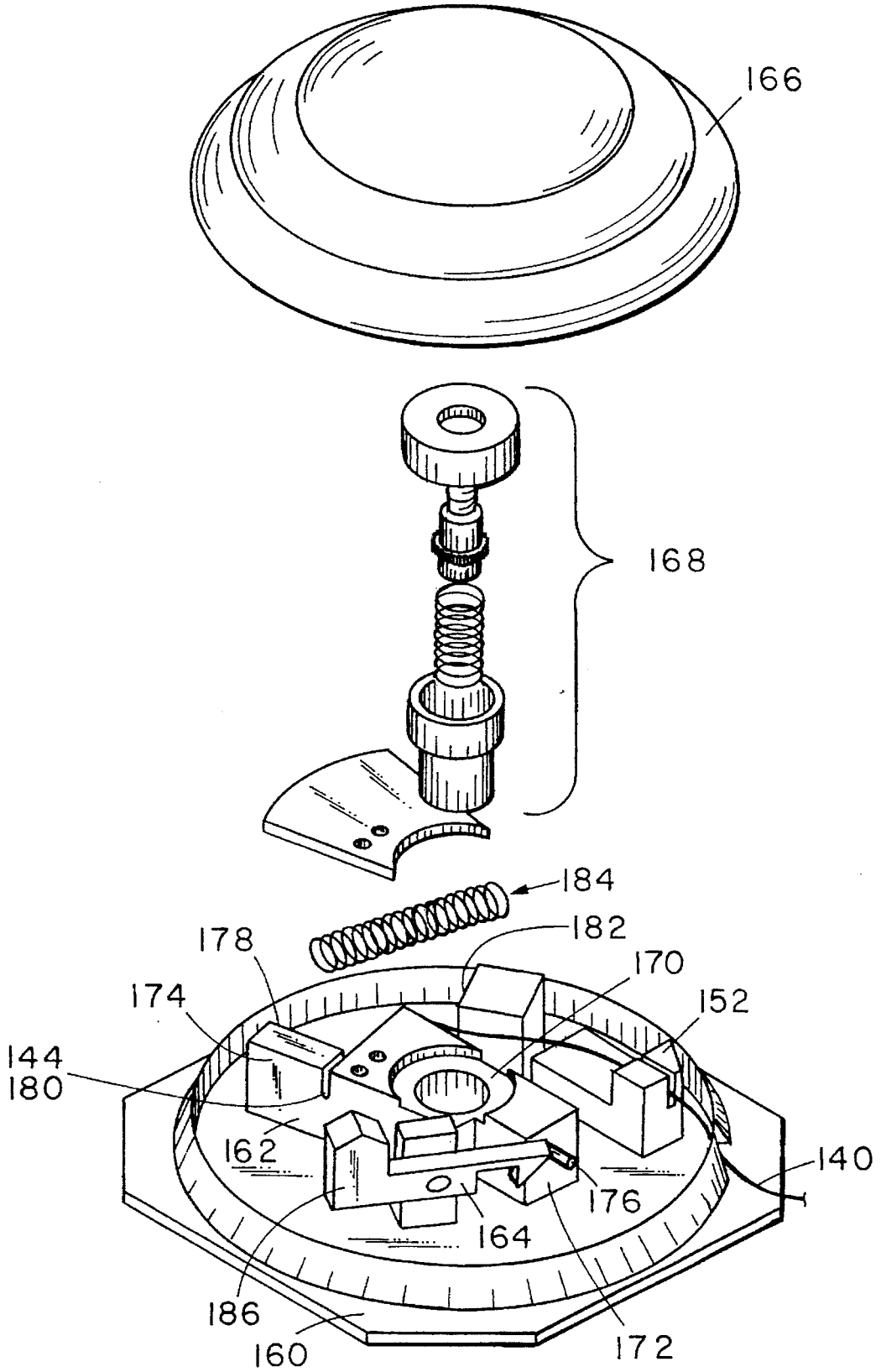
FIG. 9 is an exploded view of a chest target according to the invention.
Figure 10:
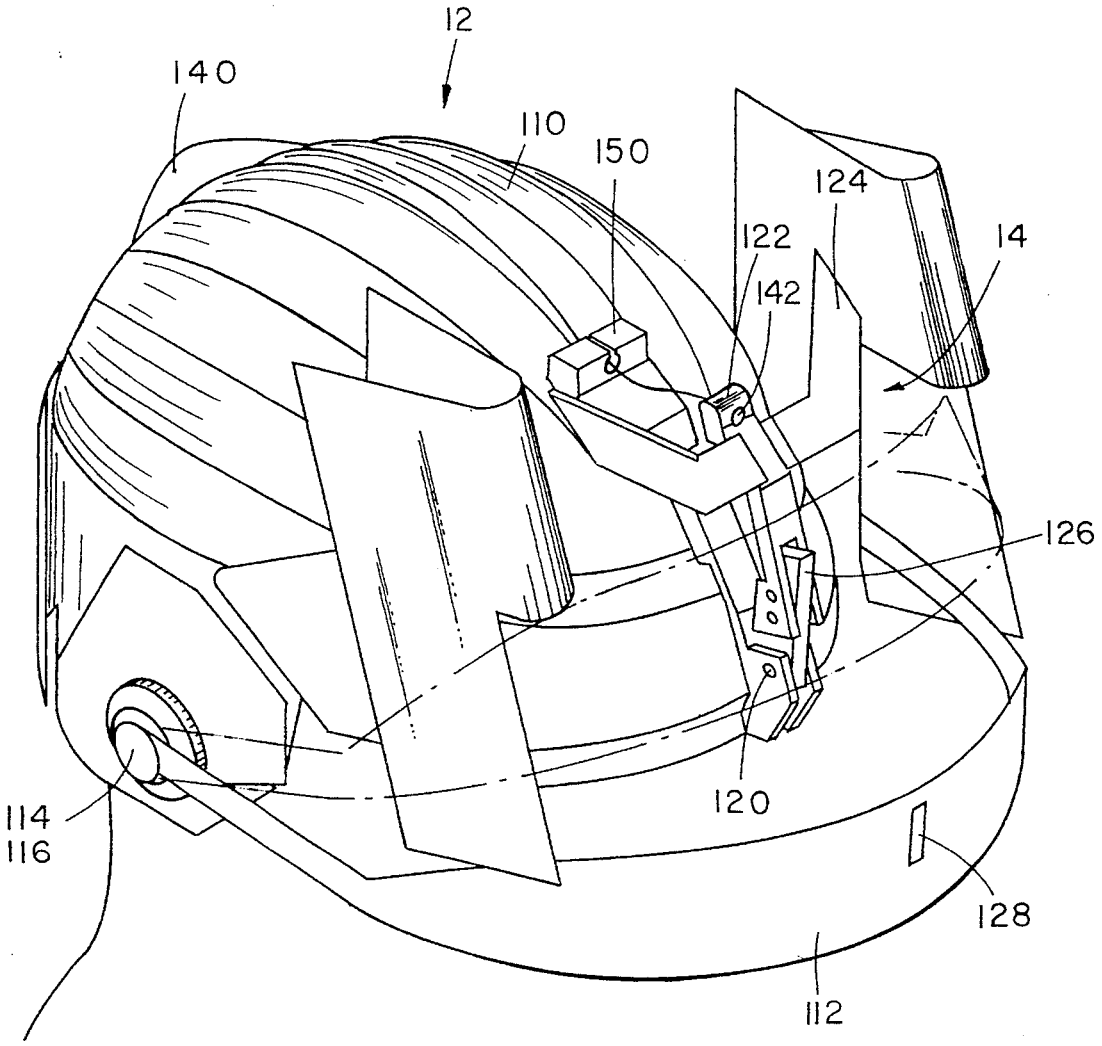
FIG. 10 is a perspective view of a helmet according to the invention.

As is shown in FIGS. 1, 9, and 10, other scoring equipment includes helmet 12 with helmet target 14 and chest target 16. Helmet 12 (FIG. 10) may be of commonly known helmet structure with a molded shell 110 of ABS plastic or the like for example, or other suitable material, and with an inner suspension or padded liner or the like. Helmet 12 is specifically provided with a vision obscuring visor 112. Visor 112 is a generally U-shaped band of opaque material, such as a colored Lexan™ plastic or the like, for example. Visor 112 has two opposing ends 114 by which the visor is pivotally fastened to opposing sides of helmet 12 by commonly known visor pivots 116 that allow free, unassisted movement of the visor from a stored position to a deployed position. In the stored position (shown in phantom), visor 112 is located above the wearer's field of view. The visor 112 is latched and held in the storage position by helmet target 14.

Helmet target 14 is a lever assembly mounted by a target pivot 120 at the lower front edge of helmet 12. Helmet target 14 also includes a spring bias or the like to hold helmet target 14 spaced away from helmet 12. At the free end 122 of helmet target 14, opposite pivot 120, a generally U-shaped striking member 124 is provided to provide a striking area for an opposing contestant. Helmet target 14 is also configured with a visor latch 126 that engages a cooperating visor catch 128 on visor 112.

In use, visor 112 may be raised to the stored position by manual manipulation and pushing of visor 112 in a generally upward direction to rotate about pivots 116 and engage visor catch 128 with visor latch 126. A force applied to striking member 124 will move the striking member closer to helmet 12 and rotate helmet target 14 about pivot 120. As the helmet target 14 rotates toward helmet 12, visor latch 126 moves away from visor 112 and releases visor catch 128. When released, visor 112 falls freely into the deployed position to block the view of the user, signaling a successful score by the opposing contestant. Alternatively, visor pivots 116 may be spring-loaded to bias visor 112 toward the deployed position. Also, a latching arrangement may be provided to hold visor 112 in the deployed position, until released and restored to the stored position.

The chest target 16 (FIG. 9) may also actuate the release of visor 112 from the stored to the deployed position by various mechanical or electromechanical interlinkages, including a solenoid circuit, for example. The interconnection between chest target 16 and visor is, however, preferably a mechanical cable linkage 140 as shown in FIGS. 1, 9, and 10. Cable 140 has one end 142 (FIG. 10) connected with helmet target 14 at striking member 124 and extends to an opposing end 144 (FIG. 9) connected at chest target 16, as will be described in greater detail below. Cable 140 is preferably run through a sheathing in slip-fit engagement with one end of the sheathing firmly held on helmet 12 by a cable clip 150 (FIG. 10), which may be integrally formed in one piece with helmet 12 or may be a separate member securely attached by various commonly known methods to helmet 12. A second, opposing end of the cable sheathing is fixed in chest target 16 by a second clip 152 (FIG. 9).

Chest target 16 is provided with a base plate 160 (FIG. 9) to which the second cable clip 152 is attached. A swing arm 162 and a latch 164 are rotatably connected with base plate 160, while a chest target strike 166 is connected with base plate 160 by a spring mount 168 of conventional, push button-type spring mount design.

Swing arm 162 is mounted to base plate 160 by a swing pivot 170 and has two ends 172 and 174 extending from different sides of swing pivot 170. Swing arm end 172 is provided with a latch catch 176 for cooperating engagement with and release from catch 164. Swing arm end 174 is provided with a spring seat 178 and a cable seat 180 for receiving and fastening cable end 144. A second spring seat 182 extends from base plate 160 and a helical coil spring 184 extends between the two spring seats 178 and 182 to bias spring arm 162 to rotate in a counter-clockwise direction about swing arm pivot 170, as shown in FIG. 9.

In use of chest target 16, the target may be strapped upon or worn on a protective garment upon the chest of a user. If the chest target 16 is not already in the set condition or position, chest target 16 may be placed in the set condition by manipulation of helmet target free end 122 (FIG. 10) away from cable clip 150 to pull swing arm end 174 against spring 184 with cable 140 and engage latch 164 with latch catch 176.

Upon striking or otherwise exerting a depressing force upon target strike 166 (FIG. 9), the target strike 166 will depress an end 186 of latch 164, causing a rotation of latch 164 and release of latch catch 176. With release of latch catch 176, swing arm 162 is rotated by spring 184 to pull helmet target 14 (FIG. 10) with cable 140, move visor latch 126 away from visor 112, and release visor catch 128. As discussed above regarding helmet target 14, visor 112 is then released to the deployed position to block the view of the user, signalling a successful score by the opposing contestant.

Figure 11:
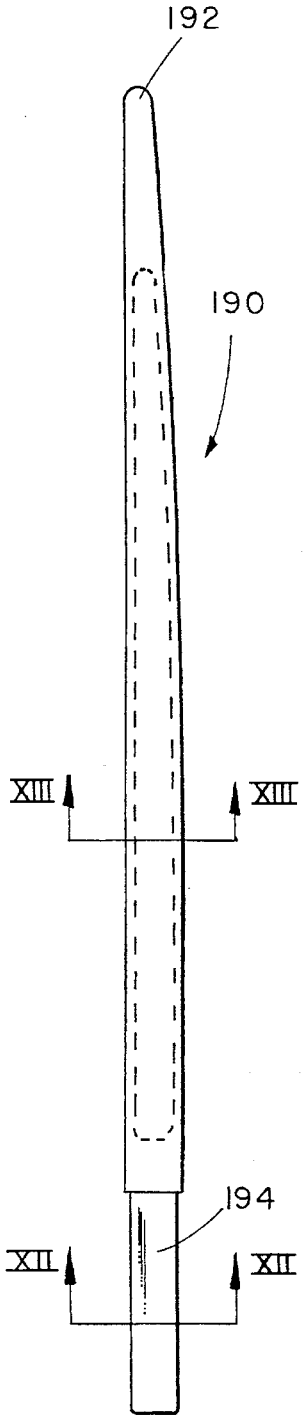
FIG. 11 is a side elevational view of a sword useable in a sword contest sport.
Figure 12:
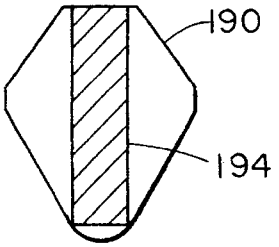
FIG. 12 is a cross-sectional view at section line XII—XII of FIG. 11.
Figure 13:
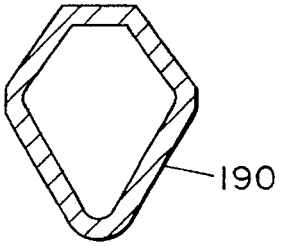
FIG. 13 is a cross-sectional view at section line XIII—XIII of FIG. 11.

As shown in FIGS. 11–13, a recommended sword 190 for the sword contest sport scoring equipment specifically disclosed herein, is an elongated member having a generally diamond-shaped cross section that presents no sharp or cutting edges. The sword 190 is provided with a hand grip 194 at one end and an opposing, preferably blunt end 192 to avoid puncture wounds. The sword 190 may be constructed of any suitable material, including, but not limited to, straight grain woods or various injection moldable or rotation moldable plastics, for example.

It will be understood by those who practice the invention and by those skilled in the art, that various modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. Scoring equipment comprising:

a first portion adapted to be worn on a limb of a contestant, near a joint of that limb;

a second portion adapted to be worn by the contestant, near the joint, on a side of the joint opposite said first portion;

a locking mechanism connected with each of said first and said second portions, said locking mechanism interconnecting said first and said second portions to be generally rotatably movable about a pivot axis between a set position and a tripped position, said locking mechanism restricting movement of said first portion and said second portion about said pivot axis when said locking mechanism is in said tripped position, said first portion and said second portion generally rotatably moving about said pivot axis unencumbered by said locking mechanism when said locking mechanism is in said set position, said lock mechanism also having apparatus to actuate said first and second portions to said tripped position, said apparatus including a target having a size and shape suitable for providing a striking area at which an opponent of the contestant can aim, said target configured to be responsive to a force applied to said target to move said target generally orthogonally toward the contestant's limb to actuate said locking mechanism and place said locking mechanism in said tripped position.

2. The scoring equipment defined in claim 1 wherein the contestant's joint has an axis of rotation and said pivot axis is oriented generally parallel with the joint axis of rotation.

3. The scoring equipment defined in claim 2 wherein said locking mechanism also includes a ratchet mechanism, said ratchet mechanism prohibiting rotation of said first portion and said second portion in a pre-determined rotational direction about said pivot axis when said locking mechanism is in said tripped position.

4. The scoring equipment defined in claim 3 wherein said ratchet mechanism includes a cog and a cooperating pawl, said pawl being biased to engage said cog.

5. The scoring equipment defined in claim 4, wherein said locking mechanism further includes a reset device connected with said pawl, said reset device being adapted to be manipulated by a user to draw said pawl away from said cog and place said locking mechanism in said set position.

6. Scoring equipment for a sword contest sport, said equipment comprising the combination of:

a first target including a first portion adapted to be worn on a limb of a contestant, near a joint of that limb; a second portion adapted to be worn by the contestant, near the joint, on a side of the joint opposite said first portion; and a locking mechanism connected with each of said first and said second portions, said locking mechanism interconnecting said first and said second portions to be generally rotatably movable about a pivot axis; and a second target including a helmet to be worn on the head of the contestant; a vision blocking visor pivotally mounted to the helmet to pivot between a first position in which the contestant's vision is unobstructed by said visor and a second position in which the contestant's vision is blocked by said visor; and a trip mechanism connected with said visor to hold said visor in said first position and release said visor to said second position, said trip mechanism being responsive to a force applied to said trip mechanism.

7. The scoring equipment defined in claim 6, wherein said trip mechanism includes a lever pivotally mounted on said helmet.

8. The scoring equipment defined in claim 7, wherein said lever is provided with a latch and said visor is provided with a cooperating catch, said latch engaging said catch when said visor is in said first position, said lever rotating about said pivot to disengage said latch from said catch and release said visor to said second position.

9. The scoring equipment defined in claim 8, wherein said trip mechanism includes a target strike separate from said helmet, said target strike being configured to be worn upon the contestant and operatively connected with said lever to manipulate said lever and disengage said latch from said catch.

10. The scoring equipment defined in claim 9, wherein said target strike is operatively connected with said lever by a cable, said cable having a first end connected with said lever and an opposing second end connected with said target strike.

11. The scoring equipment defined in claim 10, wherein said trip mechanism further includes a base plate; a strike lever pivotally connected with said base plate, said second end of said cable being connected with said strike lever; a strike latch connected with said base plate, said strike lever also being provided with a cooperating strike catch, said strike latch engaging said strike catch when said visor is in said first position, said strike lever being biassed to manipulate said lever with said cable to release said visor to said second position.

12. Scoring equipment comprising:

a helmet;

a vision blocking visor pivotally mounted to the helmet to pivot between a first position in which the vision of a user who wears the helmet is unobstructed by said visor and a second position in which the user's vision is blocked by said visor;

a lever pivotally mounted on said helmet, said lever being provided with a latch and said visor being provided with a cooperating catch, said latch engaging said catch when said visor is in said first position, said lever rotating about said pivot to disengage said latch from said catch and release said visor to said second position; and a trip mechanism operatively connected with said lever to manipulate said lever from said first position to said second position.

13. The scoring equipment defined in claim 12 wherein said trip mechanism includes a target strike separate from said helmet, said target strike being configured to be worn upon the contestant and operatively connected with said lever to manipulate said lever and disengage said latch from said catch.

14. The scoring equipment defined in claim 13, wherein said target strike is operatively connected with said lever by a cable, said cable having a first end connected with said lever and an opposing second end connected with said target strike.

15. The scoring equipment defined in claim 14, wherein said trip mechanism further includes a base plate; a strike lever pivotally connected with said base plate, said second end of said cable being connected with said strike lever; a strike latch connected with said base plate, said strike lever also being provided with a cooperating strike catch, said strike latch engaging said strike catch when said visor is in said first position, said strike lever being biassed to manipulate said lever with said cable to release said visor to said second position.

* * * * *